US011206914B2

(12) United States Patent
Lababidi

(10) Patent No.: US 11,206,914 B2
(45) Date of Patent: Dec. 28, 2021

(54) FACE MASK

(71) Applicant: Mohamad Hani Lababidi, Columbia, SC (US)

(72) Inventor: Mohamad Hani Lababidi, Columbia, SC (US)

( * ) Notice: Subject to any disclaimer, the term of this patent is extended or adjusted under 35 U.S.C. 154(b) by 189 days.

(21) Appl. No.: 16/429,773

(22) Filed: Jun. 3, 2019

(65) Prior Publication Data

US 2020/0375342 A1 Dec. 3, 2020

(51) Int. Cl.
*A45D 44/00* (2006.01)

(52) U.S. Cl.
CPC ..... *A45D 44/002* (2013.01)

(58) Field of Classification Search
CPC ..... A41D 13/11; A41D 13/1161; A41D 2300/32; A41D 13/113; A45D 44/12; A61F 13/122; A61F 13/124; A61F 13/126; A61F 2007/0003; A61F 2007/0258; Y10S 2/909; A41G 7/00
See application file for complete search history.

(56) References Cited

U.S. PATENT DOCUMENTS 495,265 A 4/1893 Pinault
2,914,772 A 8/1955 Lemelson
3,606,890 A 9/1971 Gilbert
3,768,100 A 10/1973 Colman et al.
3,971,387 A * 7/1976 Mantell ..... A61N 1/22 607/140
4,095,290 A 6/1978 O'Brien
4,658,811 A 4/1987 Beaird
4,666,148 A 5/1987 Crawford
4,945,907 A 8/1990 Tayebi
5,094,236 A 3/1992 Tayebi
5,374,458 A 12/1994 Burgio
5,701,892 A 12/1997 Bledstein
7,774,858 B2 8/2010 Kayerod
8,458,812 B2 6/2013 Kayerod
10,064,751 B2 9/2018 Young
10,098,397 B2 10/2018 McClinsey, Jr.
2004/0013828 A1* 1/2004 Tewes-Schwarzer ..... A61K 8/0212 428/34.1
2005/0187502 A1* 8/2005 Krempel ..... A61F 7/02 602/5
2006/0048278 A1 3/2006 Pitsolis
2008/0051860 A1 2/2008 Wyk
2008/0306507 A1 12/2008 Woodley
(Continued)

*Primary Examiner* — Tatyana Zalukaeva
*Assistant Examiner* — Hans Kaliher
(74) *Attorney, Agent, or Firm* — B. Craig Killough; Hellman & Yates, PA

(57) ABSTRACT

A face mask usable with skin preparations is formed in a plurality of sections. Each of the sections has elastic properties. Each section attaches to one or more adjoining sections. The positioning of the sections relative to each other is selectively variable by the user. The sections are connected so as to form a mask having a height and width as constructed by the user. The sections are selectively positioned and spaced apart to provide openings for the eyes and/or the nose and/or the mouth of a user.
An absorbent material that absorbs the desired skin preparation composition applied to the face may be attached to the plurality of the sections and behind the plurality of sections and adjacent to the face.

15 Claims, 7 Drawing Sheets

(56) References Cited

U.S. PATENT DOCUMENTS

| | | | | |
|---|---|---|---|---|
| 2014/0318565 | A1* | 10/2014 | Ito | A45D 44/002 132/200 |
| 2015/0335080 | A1 | 11/2015 | Giles | |
| 2016/0089534 | A1 | 3/2016 | Mohammadi et al. | |
| 2016/0089535 | A1 | 3/2016 | Mohammadi et al. | |
| 2016/0089536 | A1 | 3/2016 | Mohammadi et al. | |
| 2016/0128398 | A1 | 5/2016 | Fallon | |
| 2016/0227905 | A1 | 8/2016 | Eisenberg | |
| 2017/0095681 | A1 | 4/2017 | Smaller | |
| 2017/0209309 | A1 | 7/2017 | Lazor | |
| 2017/0231813 | A1* | 8/2017 | Huang | A45D 44/002 607/109 |
| 2018/0185251 | A1 | 7/2018 | Choi | |
| 2018/0220776 | A1 | 8/2018 | Eisenberg | |

* cited by examiner

FACE MASK

BACKGROUND OF THE INVENTION

Face masks are used to assist in applying skin preparations to the face. Preparations that hydrate skin, slough away dead cells, reduce blemishes, provide cleansing and other beneficial results to the facial skin may be applied using a face mask.

Face masks for applying compositions that are beneficial to the skin fall generally into two categories. The first category is masks that are formed from a preparation that is applied to the skin, and upon setting or drying of the composition, a mask is formed over the skin that is peeled away after use. The second category, to which this invention is directed, is a mask that is placed over the composition that is beneficial to the facial skin. The problem with the second category of face masks is that the size and architecture of the user's faces varies. Accordingly, masks in common use that are formed in one piece do not fit substantially all users.

There is a need for a face mask for applying preparations to the skin that will fit a variety of sizes and shapes of human faces. If the face mask does not optimally fit the user's face, the associated preparation for application to the skin is not optimized.

SUMMARY OF THE INVENTION

The present invention is a face mask formed in a plurality of sections. Each of the sections has elastic properties. Each section attaches to one or more adjoining sections. The positioning of the sections relative to each other is selectively variable by the user. The sections are connected so as to form a mask having a height and width as constructed by the user. The sections are selectively positioned and spaced apart to provide openings for the eyes and/or the nose and/or the mouth of a user.

An absorbent material that absorbs the desired composition to be applied to the face may be attached to the plurality of the sections and behind the plurality of sections and adjacent to the face.

BRIEF DRAWING DESCRIPTION

FIGS. 5, 6, 7 and 8 demonstrate connection options of the plurality of sections of the face mask to achieve a face mask having different heights and widths, with the sizes of openings formed by the spaced apart sections also being different.

Figure 2:
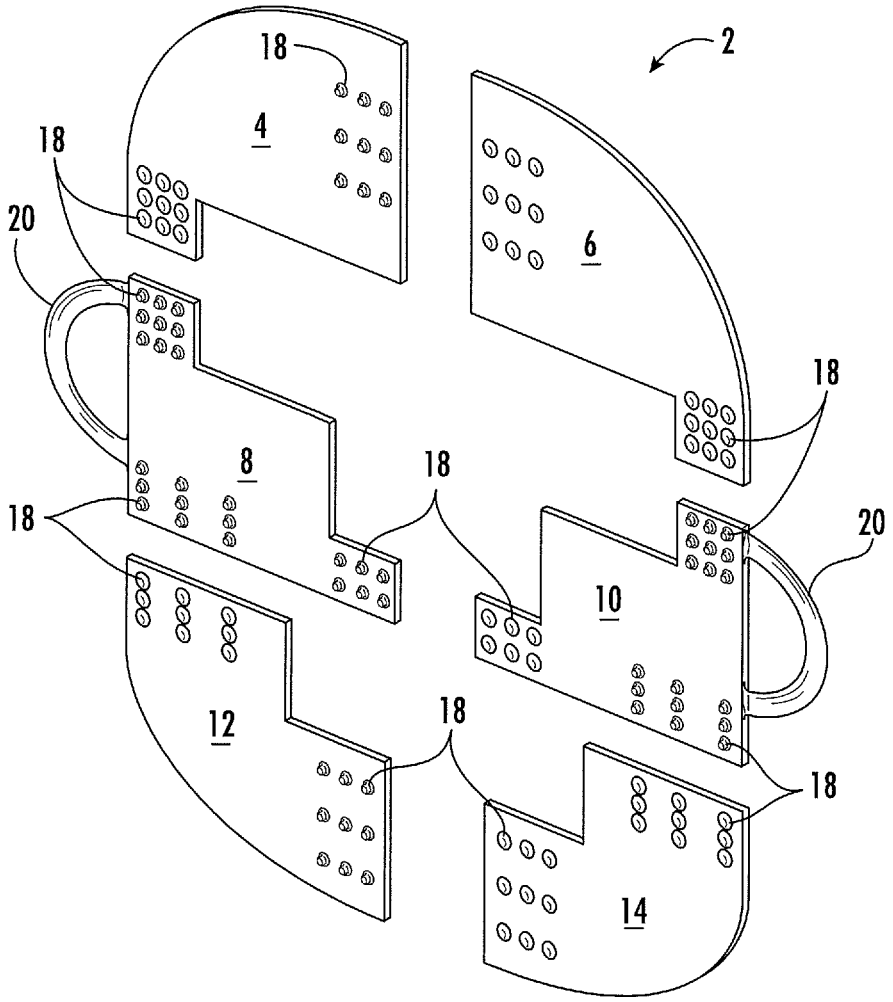
FIG. 2 shows the face mask of FIG. 1, with the plurality of sections according to an embodiment of the invention disconnected and spaced apart.
Figure 3:
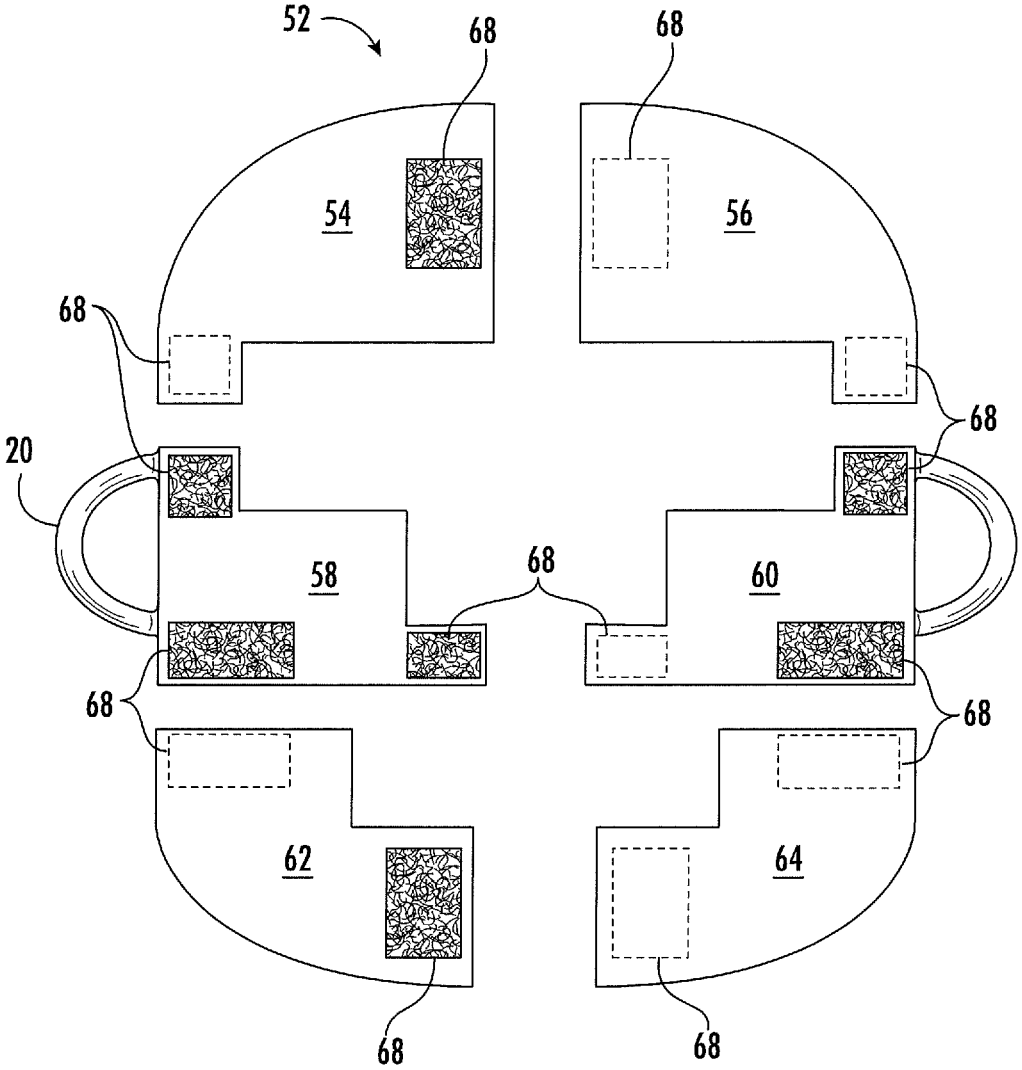
FIG. 3 is an elevation of another embodiment of the face mask.
Figure 4:
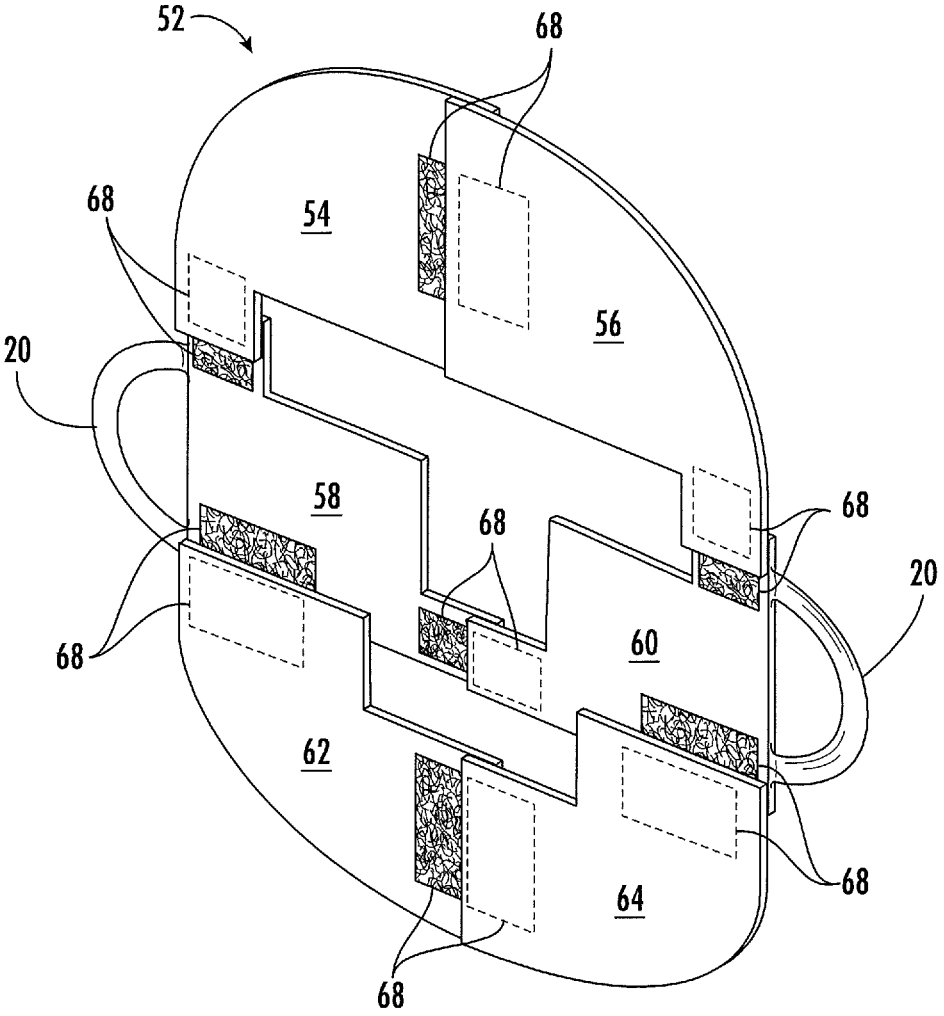
FIG. 4 shows the face mask of FIG. 2, with the plurality of sections selectively connected.
Figure 5:
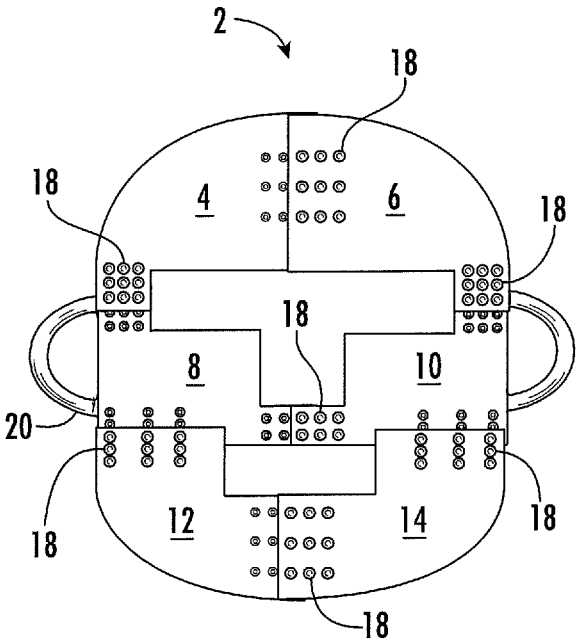
Figure 6:
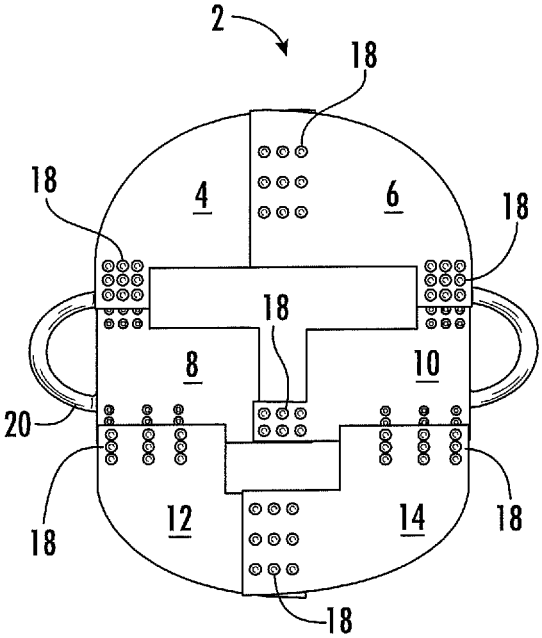
Figure 7:
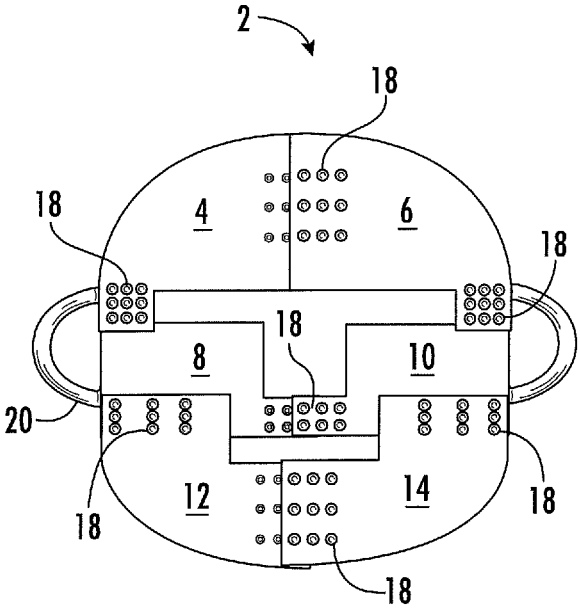
Figure 8:
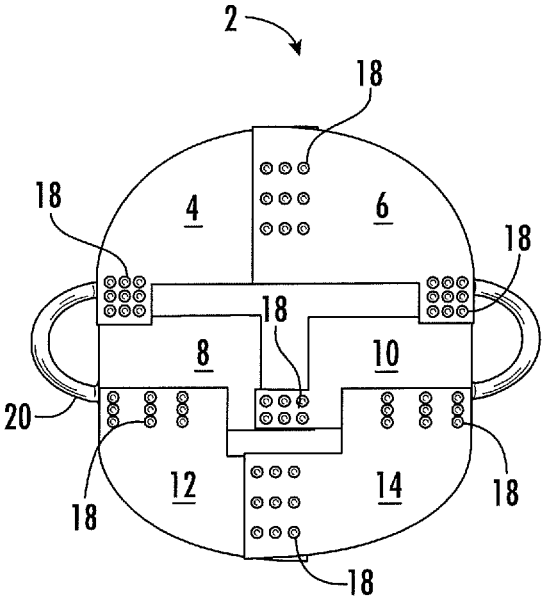
Figure 9:
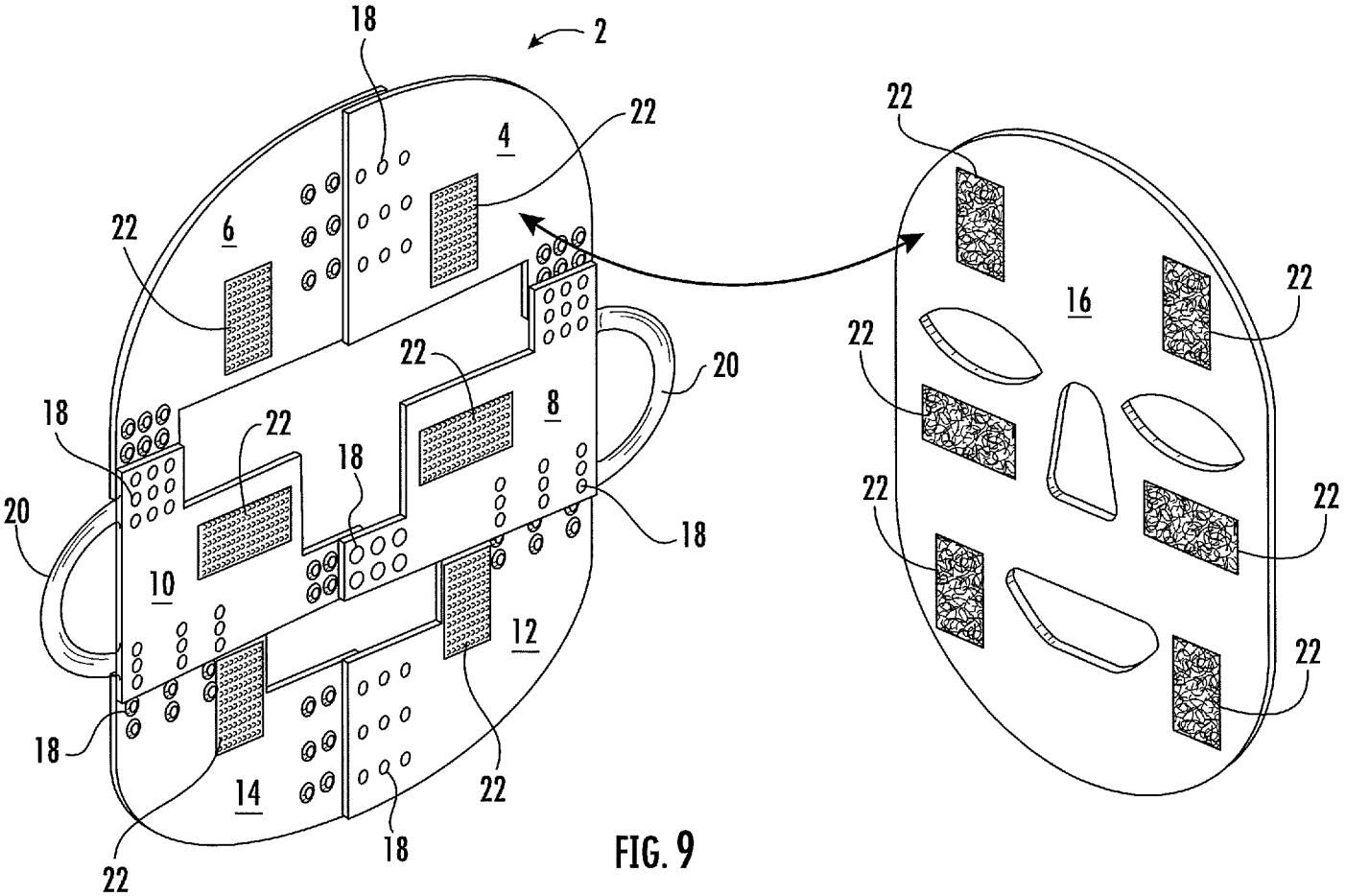

FIG. 9 shows an opposite side of the face mask shown in FIG. 2 or FIG. 4, and an absorbent material that is connectable to the face mask.

Figure 10:
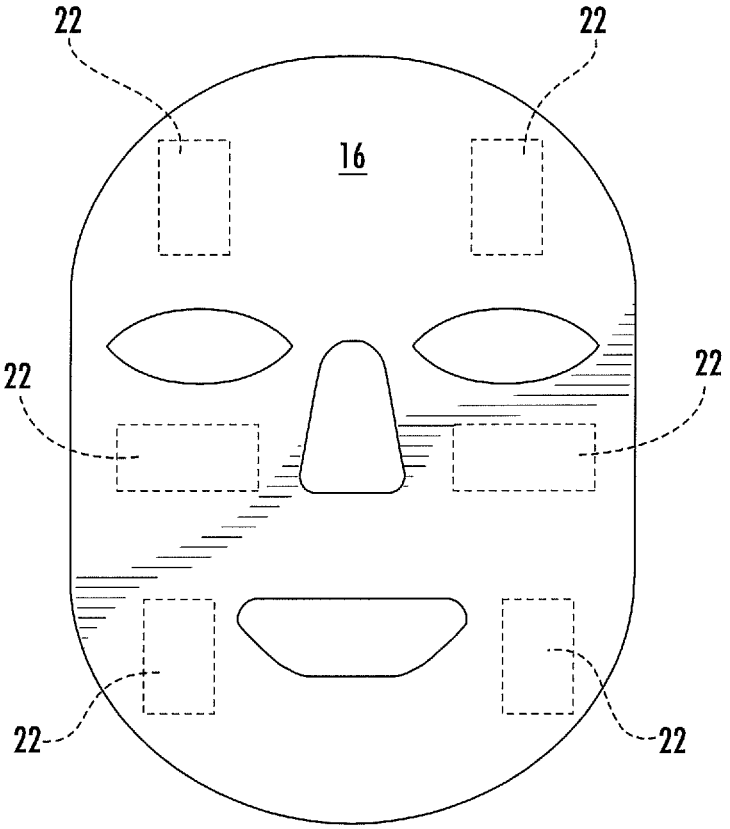

FIG. 10 shows an opposite side of the absorbent material shown in FIG. 9.

DESCRIPTION OF PREFERRED EMBODIMENTS

Figure 1:
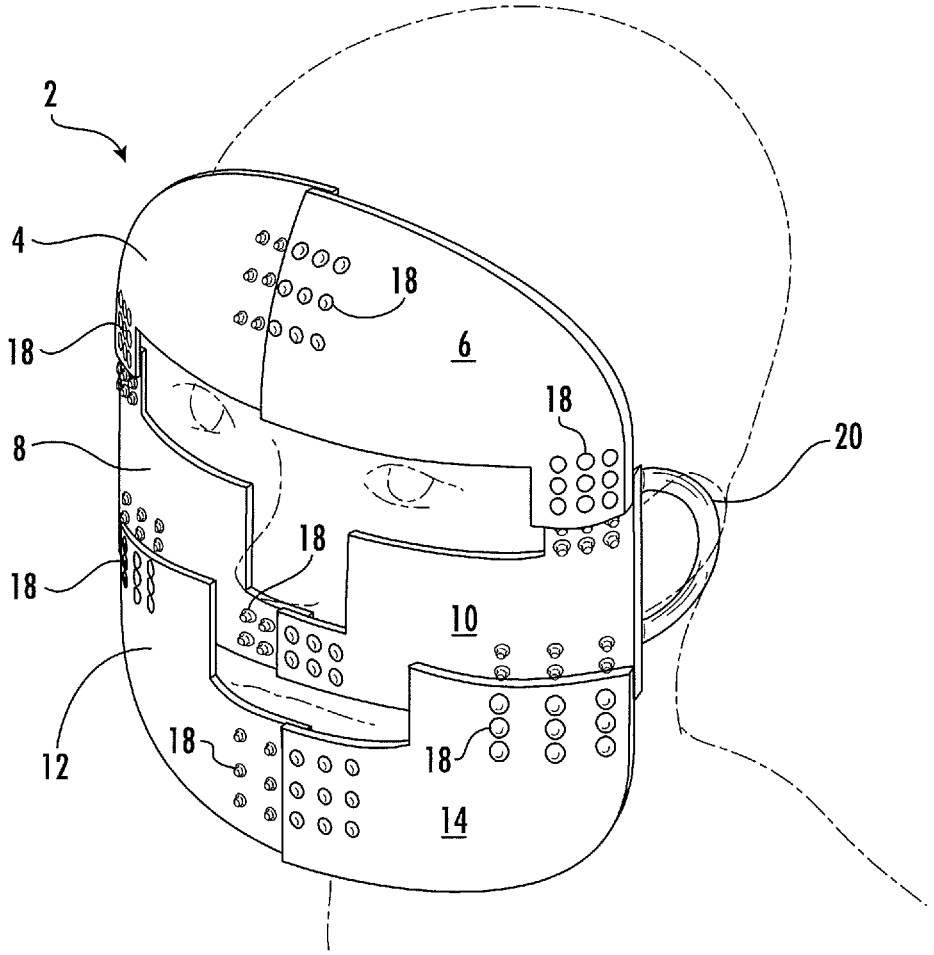
FIG. 1 is a perspective view of the face mask formed in a plurality of sections according to an embodiment of the invention, with a user of the face mask shown in broken lines.

FIG. 1 shows the face mask 2 according to an embodiment of the invention. The face mask comprises a plurality of sections. As shown in FIG. 2, the face mask may have six sections. The sections may include a right section 4 and a left section 6 (from the user's perspective) that are positioned above the eyes. A right section 8 and a left section 10 that are positioned below the eyes (but above the mouth) of a user, and a right section 12 and a left section 14 that are positioned generally below the mouth of a user.

In one embodiment, matrices of snaps 18 are used to connect the sections 4, 6, 8, 10, 12, 14 of the plurality of sections. The snaps may have a male part in a section of the plurality of sections and a female part in an adjoining section that connect to hold the sections together in the desired location. Each matrix of snaps allows positioning of the sections to be selectively varied by the user and by location of snaps of one section relative to a location of the corresponding snaps of an adjoining section or sections. As shown in the drawing figures, in an embodiment wherein the face mask comprises six sections, each section connects to at least two other sections. Locating the snaps up or down relative to a location of the section immediately above or below allows the height of the mask to be adjusted, while positioning of the location of the snaps left or right relative to the adjoining section width of the face mask or a part of the width of the face mask to be selectively varied by the user.

FIG. 5 through FIG. 8 demonstrate selective variability of the positioning of the connectors 18 of the sections 4, 6, 8, 10, 12, 14 to vary the height and/or width of the face mask 2. As can be seen in FIG. 5 through FIG. 8, varying the location of the sections by positioning of the connectors also varies the geometry of the opening for the eyes formed by the sections. Similarly, the size of the opening in the mask for the mouth is varied by selectively varying the locations of the lower sections 8, 10, 12, 14 of the face mask relative to each other. Each drawing figure in this group presents optional locations of the attachments of the connectors so as to vary the shape of the face mask to optimally accommodate a user's face.

In one example, section 4 comprises a connector and section 6 comprises a corresponding connector. Section 4 is connected by the connector to section 6. The width of the construct formed by these sections is selectively variable by location of the connector of section 4 relative to a location of the connector of section 6. Section 8 comprises a connector and section 10 comprises a corresponding connector. Section 8 is connected by the connector to section 10. The width of the construct formed by these sections is selectively variable by location of the connector of section 4 relative to a location of the connector of section 6. The same process is used to form a construct with section 12 and section 14. The height of the face mask may be selected by the relative location of the connectors that connect section 8 to section 4 and the connectors that connect section 10 to section 6, and the connectors that connect section 12 to section 8, and the connectors that connect section 14 to section 10. The spacing of openings for the eyes, nose and mouth are also variable in this manner. FIG. 5 through FIG. 8

In a preferred embodiment, the face mask is held in place by a loop 20 extending from the left side of the face mask and a loop 20 extending from the right side of the face mask that is constructed and arranged to surround the ears of a user, as shown in FIG. 1. The mask and the loop are preferred to be formed of a material having elastic properties. This allows the mask to be stretched as necessary to be held in place by the engagement of the loops with the ears of the user.

In preferred embodiments, the sections of the face mask 2 may be formed of a rubber composition or an elastomer. In a particular embodiment, the face mask is formed of a gas permeable material such as a gas permeable elastomer that allows air to pass through the mask. However, it is preferred that the mask is not sufficiently porous so that the compositions applied under the mask, such as compositions applied to the absorbent layer, do not leach through the face mask or prematurely dry. In one particular embodiment, the plurality of sections are formed of silicone.

In another embodiment, hook and loop 68 material is used as a connector rather than a plurality of snaps or matrix of snaps. Hook or loop material is applied to one section, and the corresponding hook or loop material that facilitates attachment is applied to the adjacent section of the plurality of sections. For example, if section 4 has hook material as a connector, then section 6 will have loop material as a connector at the area of connection of these sections. Conversely, if section 4 has loop material as a connector, then section 6 will have hook material as a connector. The hook and loop material may be located relative to the hook or loop material of the adjacent section so as to provide a face mask that is selectively variable in height and width according to the purposes of the invention.

In one embodiment, a selected preparation for the skin is applied directly to the skin of the user. The face mask 2 is then configured by locating the connectors as desired to vary height and width of the face mask, and the size of the openings of the face mask. The face mask is placed over the skin preparation and the face mask holds the preparation against the skin. The preparation may be a medicament, a moisturizer, a cosmetic or other material that the user wishes to apply to the skin. The face mask prevents premature drying of the composition, even in embodiments that provide gas permeability. The face mask also prevents the preparation from being wiped away, such as when sleeping.

In a preferred embodiment, an absorbent material 16 is attached behind the face mask 2 and to the face mask. The absorbent material is preferred to be sized to cover substantially the entire area of the face mask, at least when the face mask is selectively constructed to its smallest surface area. The face mask and the absorbent material have corresponding connectors, such as snaps or hook and loop material 22 that hold the absorbent material against the face mask. The absorbent material is coated with the desired composition or preparation and attached to the face mask, with the composition or preparation opposite the face mask. The face mask is then used as described above by positioning the face mask with the coated absorbent material over the face of the user after the user locates the plurality of sections to fit his or her face. The absorbent material may be washed separately from the face mask after use, or the absorbent material may be replaced and then reused with the same preparation or composition or other compositions, while the face mask is typically wiped clean and reused. Openings for the eyes, the nose and the mouth are provided in the embodiment as shown. The absorbent material may be formed of a textile material.

What is claimed:

1. A face mask comprising a plurality of sections, each section of the plurality of sections comprising elastic properties, wherein the plurality of sections comprises a first section of the face mask that is constructed and arranged for positioning above eyes of a user, and a second section of the face mask that is constructed and arranged for positioning below the eyes of the user, and wherein the first section of the face mask comprises a connector area on a surface thereof and the second section of the face mask comprises a connector area on a surface thereof, wherein the connector area of the first section of the face mask is constructed and arranged to attach to the connector area of the second section of the face mask by contact of the connector area of the first section of the face mask to the connector area of the second section of the face mask wherein the connector area of the first section of the face mask faces the connector area of the second section of the face mask, and engagement of the first connector area of the face mask with the second connector area of the face mask causes attachment of the first section of the fac mask to the second section of the face mask, wherein the first section of the face mask comprises a left section and a right section wherein the left section of the first section of the face mask comprises a connector area on a surface thereof and the right section of the first section of the face mask comprises a connector area on a surface thereof, wherein the connector area of the right section of the first section is constructed and arranged to attach to the connector area of the left section of the first section by contact of the connector area of the right section of the first section to the connector area of the left section of the first section, wherein the connector area of the right section of the first section faces the connector area of the left section of the first section, and the connector area of the right section of the first section contacts the connector area of the left section of the first section and engagement of the connector area of the right section of the first section with the connector area of the left section of the first section causes attachment of the right section of the first section to the left section of the first section, wherein the second section of the face mask comprises a left section and a right section, wherein the left section of the second section of the face mask comprises a connector area on a surface thereof and the right section of the second section of the face mask comprises a connector area on a surface thereof, wherein the connector area of the right section of the second section is constructed and arranged to attach to the connector area of the left section of the second section by contact of the connector area of the right section of the second section to the connector area of the left section of the second section, wherein the connector area of the right section of the second section faces the connector area of the left section of the second section, and the connector area of the right section of the second section contacts the connector area of the left section of the second section and engagement of the connector area of the right section of the second of the section with the connector area of the left section of the second section causes attachment of the right section of the second section to the left section of the second section, and wherein a height and width of the face mask is selectively variable by location of each section of the face mask relative to a location of every other section of the face mask.

2. A face mask as described in claim 1, wherein the connector area of the first section comprises a plurality of spaced apart snaps and the connector area of the second section comprises a plurality of spaced apart snaps that are constructed to engage the plurality of spaced apart snaps of the first section by engagement of male snaps with corresponding female snaps.

3. A face mask as described in claim 1, wherein the connector area of the first section is hook material or loop material and the connector area of the second section is hook material or loop material that engages the hook material or loop material of the first section to connect the hook material to the loop material.

4. A face mask as described in claim 1, wherein a portion of the first section of the plurality of sections is spaced apart from the second section of the plurality of sections.

5. A face mask as described in claim 1, further comprising a face mask comprising an absorbent material selectively attached by a plurality of fasteners to the first section of the plurality of sections and on the surface of the first section comprising the connector area and an absorbent material selectively attached by a plurality of fasteners to the second section of the plurality of sections.

6. A face mask as described in claim 1, further comprising a face mask comprising an absorbent material selectively attached by a plurality of fasteners to the first section of the plurality of sections, and an absorbent material selectively attached by a plurality of fasteners to the second section of the plurality of sections, wherein the mask comprising of absorbent material comprises an opening corresponding to a portion of the first section of the plurality of sections that is spaced apart from the second section of the plurality of sections.

7. A face mask as described in claim 1, wherein each section of the plurality of sections comprises an elastomeric material.

8. A face mask as described in claim 1, wherein each section of the plurality of sections comprises gas permeable elastomer.

9. A face mask as described in claim 1, wherein each section of the plurality of sections comprises silicone.

10. A face mask as described in claim 1, wherein each section of the plurality of sections comprises rubber.

11. A face mask as described in claim 1, wherein a first loop extends from a right side of the face mask and a second loop extends from a left side of the face mask and wherein the first loop and the second loop are constructed and arranged to surround ears of a user.

12. A face mask as described in claim 1, wherein the connector area of the first section of the face mask comprises a plurality of snaps formed as a grid, and the plurality of snaps of the connector area of the first section of the face mask are all formed as a male snap or a female snap, and the connector area of the second section of the face mask comprises a plurality snaps all formed as a male snap or a female snap, and first section of the face mask and the second section of the face mask are constructed and arranged such that the first section of the face mask comprises all male snaps and the second section of the face mask comprises all female snaps or the first section of the face mask comprises all female snaps and the second section of the face mask comprises all male snaps so that engagement of the connector area of the first section of the face mask with the connector area of the second section attaches the first section of the face mask to the second section of the face mask.

13. A face mask as described in claim 1, wherein the connector area of the second section of the face mask comprises a plurality of snaps formed as a grid, and the plurality of snaps of the connector area of the second section of the face mask are all formed as a male snap or a female snap, and the connector area of the first section of the face mask comprises a plurality snaps all formed as a male snap or a female snap, and first section of the face mask and the second section of the face mask are constructed and arranged such that the first section of the face mask comprises all male snaps and the second section of the face mask comprises all female snaps or the first section of the face mask comprises all female snaps and the second section of the face mask comprises all male snaps so that engagement of the connector area of the first section of the face mask with the connector area of the second section attaches the first section of the face mask to the second section of the face mask.

14. A face mask as described in claim 1, wherein increasing overlap of the first section of the face mask with the second section of the face mask while maintaining engagement of the connector area of the first section with the connector area of second section decreases height of the face mask and decreasing overlap of the first section of the face mask with the second section of the face mask while maintaining engagement of the connector area of the first section with the connector area of the section increases height of the face mask.

15. A face mask as described in claim 1, wherein increasing overlap of the right section of the first section with the left section of the first section while maintaining engagement of the connector area of the right section of the first section with the connector area of the left section of the first section decreases the width of the first section of the face mask and decreasing overlap of the right section of the first section with the left section of the first section of the face mask while maintaining engagement of the connector area of the right section of the first section with the connector area of the left section of the first section increases width of the first section of the face mask, and wherein increasing overlap of the first section of the face mask with the second section of the face mask while maintaining engagement of the connector area of the first section of the face mask with the connector area of the second section of the face mask decreases height of the face mask and decreasing overlap of the first section of the face mask with the second section of the face mask while maintaining engagement of the connector area of the first section with the connector area of the second section increases height of the face mask.

* * * * *